US006616360B2

(12) United States Patent
Lehmkuhl

(10) Patent No.: US 6,616,360 B2
(45) Date of Patent: Sep. 9, 2003

(54) LABEL PRINTER END AND PLOTTER CUTTING ASSEMBLY

(75) Inventor: Wade E. Lehmkuhl, Bloomington, MN (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 09/683,718

(22) Filed: Feb. 6, 2002

(65) Prior Publication Data

US 2003/0146944 A1 Aug. 7, 2003

(51) Int. Cl.[7] ..... B41J 11/70; B41J 11/66; B26D 5/00; B26D 5/20

(52) U.S. Cl. ..... 400/621; 400/352; 83/39; 83/37

(58) Field of Search ..... 83/212.1, 213, 83/940, 47, 39, 37, 425.3, 425.4; 400/621, 621.1, 352; 346/24

(56) References Cited

U.S. PATENT DOCUMENTS 4,685,363 A * 8/1987 Gerber ..... 83/22
5,074,178 A * 12/1991 Shetley et al. ..... 83/47
5,078,523 A 1/1992 McGourty et al. ..... 400/613

(List continued on next page.)

FOREIGN PATENT DOCUMENTS

JP 63154378 A * 6/1988 ..... B41J/11/66
JP 05057681 A * 3/1993 ..... B26D/5/00

OTHER PUBLICATIONS

U.S. patent application Ser. No. 09/683,717, filed Feb. 6, 2002, pending.

Brochure—Brady® Make–It–Yourself Products, It's Important to use the Right Tool for the Right Job, Brady Worldwide, Inc., 1999.

Brochure—Brady® Graphic Solutions, GraphicsPro™ Label & Sign Creator Offers the Convenience of Custom Labels and Signs at the Touch of a Fingertip, W.H. Brady Co./Brady USA, Inc., 1997.

Brochure—Impressa 2 digital label & decal press, Print and Cut Your Own Full–Color Labels and Decals in any Size or Shape!, pp. 1–6, Primera Technology, Inc., 1998.

Brochure—ColorCAMM PRO Versatility, Roland DGA Corporation, 2000.

Brochure—The Future of Sign Making is here, Gerber Edge, Gerber Scientific Products, Inc., 1994.

*Primary Examiner*—Daniel J. Colilla
(74) *Attorney, Agent, or Firm*—Whyte Hirschboeck Dudek SC

(57) ABSTRACT

Disclosed herein is cutting assembly for use with a label printer. The cutting assembly includes: a cutting assembly frame; a plotter cutter for plotter cutting a label media, the plotter cutter connected to the cutting assembly frame; an end cutter for end cutting the label media, the end cutter connected to the cutting assembly frame; and a drive mechanism connected to the plotter cutter and the end cutter. During end cutting, the plotter cutter is coupled to the end cutter such that both the plotter cutter and end cutter are driven by the drive mechanism. During plotter cutting, the plotter cutter is uncoupled from the end cutter such that only the plotter cutter is driven by the drive mechanism. Also, during end cutting, the plotter cutter slide rail rotates about a pivot such that the plotter cutter is lifted off of the label media and during plotter cutting, the plotter cutter slide rail rotates about the pivot such that the plotter cutter is lowered into a plotter cutting position to plotter cut the label media. The invention accommodates both end and plotter cutting of a label media by way of a common drive.

29 Claims, 12 Drawing Sheets

U.S. PATENT DOCUMENTS

| | | | | | |
|---|---|---|---|---|---|
| 5,138,341 | A | | 8/1992 | Kobayashi | 346/136 |
| 5,157,761 | A | | 10/1992 | Hawkes | 395/107 |
| 5,163,675 | A | | 11/1992 | Sunohara | 271/274 |
| 5,188,009 | A | | 2/1993 | Sunohara et al. | 83/13 |
| 5,202,958 | A | | 4/1993 | Kobayashi | 395/102 |
| 5,275,077 | A | | 1/1994 | Kobayashi | 83/880 |
| 5,303,624 | A | * | 4/1994 | Ventham et al. | 83/202 |
| 5,318,370 | A | | 6/1994 | Nehowig | 400/613 |
| 5,511,891 | A | | 4/1996 | Nehowig et al. | 400/583 |
| 5,755,519 | A | | 5/1998 | Klinefelter | 400/249 |
| 5,823,689 | A | | 10/1998 | Nehowig et al. | 400/83 |
| 5,823,692 | A | | 10/1998 | Tolrud et al. | 400/582 |
| 5,887,993 | A | | 3/1999 | Nunokawa et al. | 400/208 |
| 6,007,263 | A | | 12/1999 | Imai et al. | 400/693 |
| 6,008,831 | A | | 12/1999 | Nakanishi et al. | 347/195 |
| 6,034,705 | A | | 3/2000 | Tolle et al. | 347/195 |
| 6,042,279 | A | | 3/2000 | Ackley | 400/103 |
| 6,046,756 | A | | 4/2000 | Iga et al. | 347/173 |
| 6,099,178 | A | | 8/2000 | Spurr et al. | 400/207 |
| 6,112,658 | A | | 9/2000 | Gunther et al. | 101/171 |
| 6,149,325 | A | | 11/2000 | Nunokawa et al. | 400/208 |
| 6,201,256 | B1 | | 3/2001 | Kouchi et al. | 250/559.44 |
| 6,213,659 | B1 | | 4/2001 | Elgee | 400/633 |
| 6,246,050 | B1 | | 6/2001 | Tullis et al. | 250/231.13 |
| 6,249,302 | B1 | | 6/2001 | Sekiya | 347/220 |
| 6,264,296 | B1 | | 7/2001 | Klinefelter et al. | 347/4 |
| 6,264,774 | B1 | | 7/2001 | Lenz et al. | 156/64 |
| 6,266,075 | B1 | | 7/2001 | Feitel et al. | 347/198 |
| D446,544 | S | | 8/2001 | Platner et al. | D18/50 |
| 6,270,858 | B1 | | 8/2001 | Paulson | 427/508 |
| 6,276,849 | B1 | | 8/2001 | Feitel et al. | 400/242 |

* cited by examiner

LABEL PRINTER END AND PLOTTER CUTTING ASSEMBLY

FIELD OF THE INVENTION

The present invention relates to cutting of a label media in a label printer. In one aspect, the invention relates to a label printer that includes a cutting assembly. In another aspect, the present invention relates to a label printer that includes a cutting assembly capable of both plotter and end cutting of a label media.

BACKGROUND OF THE INVENTION

Electronic label printing machines are often used to generate adhesive labels having images (e.g., indicia, graphics, art, specialized instructions, warnings, slogans, advertising, etc.) to facilitate identification, tracking and pricing of goods. Such label printers typically include: a print head, an assembly (e.g., a label media cartridge) for conveniently supplying or inserting a label media (also called a label media supply) into the printer so that the label media can be fed past the print head in order to be printed, a microprocessor, a read-only memory (ROM) programmed with appropriate instructions therein to operate the microprocessor, a random access memory (RAM), a keyboard with letter, number, and function keys for entry of alphanumeric information requisite to printing the indicia on the label media, and a visual display such as a light emitting diode (LED) or liquid crystal display (LCD) screen to convey information to a machine operator. These components function together to achieve the end goal of creating high quality and accurate labels from the label media using the electronic label printing machine.

Labels are made from a label media. The label media itself typically is made up of a roll of pressure sensitive tape that is attached, typically along a side containing an adhesive, to a continuous support roll of release liner material. The label media is fed in a media direction along a media path through the label printer. Discrete labels are formed by cutting the label media. Complex label shapes can be obtained by plotter cutting the tape layer only of the label media. The label media can be end cut (i.e., cutting through the tape and the release liner layers) or portioned into an end cut label media portion in order to obtain as many discrete labels in a continuous row as is desired. In other words, one or more than one discrete label can reside on an end cut label media portion. An end cutting operation can occur with or without a plotter cutting operation first having taken place. Following label media cutting, the discrete labels can be removed from the release liner and attached, as appropriate, to the particular application requiring identification. Since there are many types of label applications, there are many combinations of tape and release liners that can provide labels of varying sizes, colors, formats, and characteristics.

One type of label printer employs a thermal transfer print head. In general, the use of thermal print heads in label printers has increased as the quality and accuracy of thermal print heads has improved. Thermal transfer printing uses a heat-generating print head to transfer ink, or the like, from a thermal transfer ribbon to a label media to form a label image on the media. A microprocessor determines a sequence of individual thermal, typically resistive, print head elements to be selectively heated or energized. Energizing the sequence of elements in turn heats the ribbon so as to transfer the ink from the ribbon, creating the desired image on the label media, and specifically, on the label tape.

The label printer can be fed label media from a label media source. Simultaneously, a thermal transfer ribbon can be fed from a ribbon source. While the label media runs between the print head and a support (platen) roller, the transfer ribbon can run between the print head and the support roller. Thus, the label media and the transfer ribbon can run together in an overlay relationship between the print head and the support roller.

When it is desired to print a color image on a label media, it is generally required to print the image by passing the label media several times past the print head. To accomplish each pass, the label media is fed, retracted, and then re-fed again past the thermal print head. With each pass, a different primary color, for example, in a traditional color scheme (e.g., cyan, magenta, yellow, and black) is printed from a continuous ink ribbon onto the label media using the print head. In this manner, based on the amount of each color printed, a composite color image can be printed onto a label media.

It is continually desirable to improve the functionality, performance and/or efficiency of various components, or combinations of components (also sometimes called "assemblies" or "subassemblies") that make up label printers. For example, it would be desirable to improve the process of cutting label media in label printers.

Plotter cutting effects cutting of the tape layer of the label media only. End or shear cutting effects cutting through or substantially through the entire thickness of the label media. In the past, end and shear cutting operations have been accomplished using separate cutting machines. Moreover, plotter cutting operations have typically taken place as discrete processes, separate and apart from label printing operations.

It would be desirable to provide a cutting assembly and/or method that can accommodate both end and plotter cutting of a label media by way of a common drive. Such a device and method would reduce complexity and cost that is associated with label making.

SUMMARY OF INVENTION

The present invention generally provides a label printer cutting assembly that overcomes the aforementioned problems.

In one aspect, the cutting assembly comprises: a cutting assembly frame; a plotter cutter for plotter cutting a label media, the plotter cutter connected to the cutting assembly frame; an end cutter for end cutting the label media, the end cutter connected to the cutting assembly frame; and a drive mechanism connected to the plotter cutter and the end cutter for selectively driving at least one of the plotter cutter to effect plotter cutting of the label media and the end cutter to effect end cutting of the label media.

Various other aspects, features, objects and advantages of the present invention will be made apparent from the following detailed description and the drawings.

BRIEF DESCRIPTION OF DRAWINGS

Preferred embodiments of the invention are described below with reference to the following drawings, which are provided for illustrative purposes only. The drawings illustrate a best mode presently contemplated for carrying out the invention.

In the drawings.

DETAILED DESCRIPTION OF THE PREFERRED EMBODIMENT

In the following detailed description, references are made to the accompanying drawings which form a part of this application, and in which is shown by way of illustration specific embodiments in which the invention can be practiced. These embodiments are described in sufficient detail to enable those skilled in the art to practice the invention, and it is to be understood that other embodiments can be utilized and that various changes can be made without departing from the spirit and scope of the present invention. Moreover, in the detailed description, like numerals are employed to designate like parts throughout the same. Various items of equipment, such as fasteners, fittings, etc., in addition to various other elements and specific principles of their operation, are omitted to simplify the description. However, those skilled in the art will realize that such conventional equipment and principles of operation can be employed as desired. Locations of various of the components, including those components shown and described herein, can be varied as desired or as the applications warrant.

Figure 1:
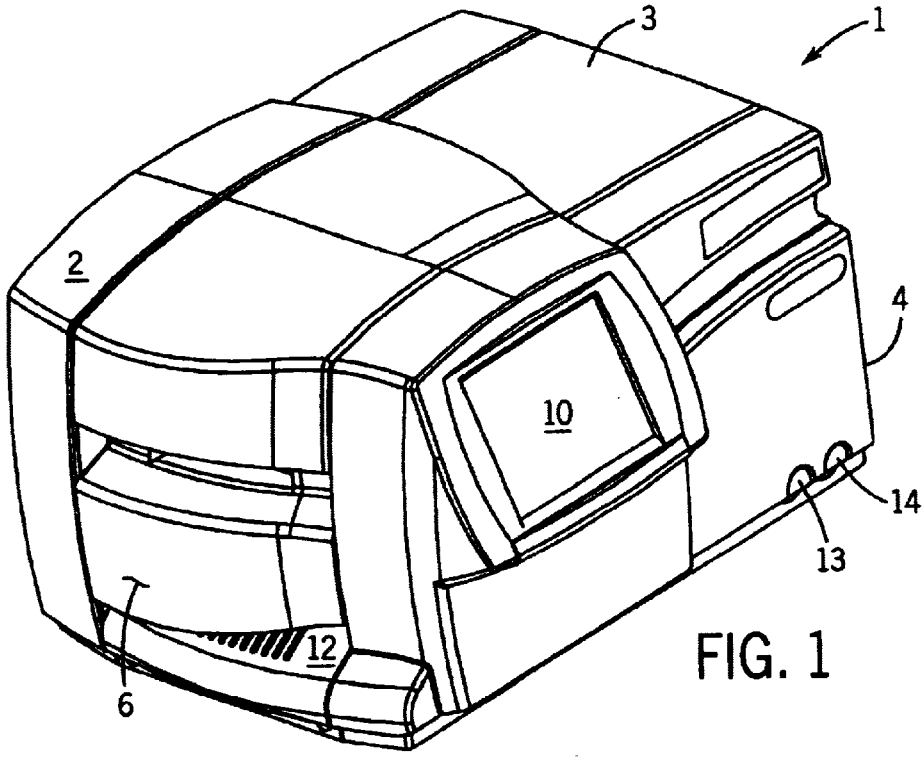
FIG. 1 is a perspective view of a label printer that can employ the present invention.
Figure 2:
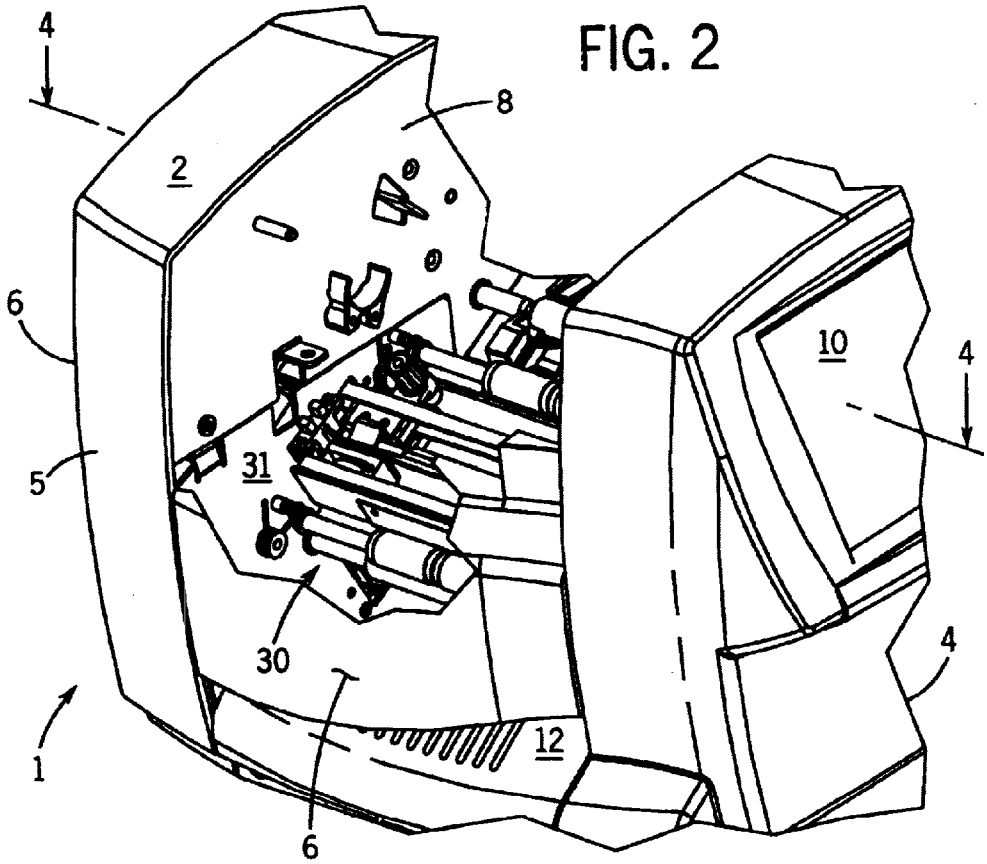
FIG. 2 is a perspective, cutaway view of a portion of the label printer of FIG. 1 with the interior of the printer partially exposed.

Shown in FIGS. 1–2, is label printer 1. In a preferred embodiment, printer 1 can accomplish both printing and cutting operations in a single unit, and thus, label printer 1 can also be referred to as a "label printer-cutter". Printer 1 includes a plastic housing 2 having a front 4, a back (not shown), a left side 6 and a right side (not shown). Printer 1 includes a cover portion 3 and a base portion 5 (FIG. 2). In FIG. 1, the cover portion is closed, and so printer 1 is shown in a configuration that is suitable for, for example, operation or transport. Cover portion 3 can be raised or opened to access the interior of printer 1. Cover portion 3 can also be raised, for example, when the printer is in an idle state, or a state suitable for loading and/or unloading a label media. Cover portion 3 can be raised by releasing a temporary securing mechanism (not shown) on left side 6 of housing 2 and applying a lifting force to the cover portion. Housing 2 supports LCD screen 10 that may be pivotally mounted to housing front 4. Printed labels (not shown) are ejected from printer 1 via exit chute 12 formed in housing side 6. LCD screen 10 can display, among other things, printer status and error indicators to a user of printer 1. First adjustment mechanism 13 (FIG. 1) can be included, for example, to control and/or adjust LCD screen 10 brightness. Other parameters, such as print or color intensity of an output label, can also be adjusted, for example, by second adjustment mechanism 14.

FIG. 2 shows a cutaway view of a portion of label printer 1. Housing 2 encloses various printer assemblies (some of which are not detailed herein to facilitate understanding of the invention), and these assemblies can be mounted to frame 8. For example, cutting assembly 30 is attached to cutting assembly frame 31, with frame 31 secured to frame 8.

Label printer assemblies (e.g., cutter assembly 30) and LCD screen 10 are controlled by printer circuitry. Housing 2 of label printer 1 can be manufactured, along with its various assemblies, according to known manufacturing principles (e.g., injection molding) and using known materials (e.g., plastic, metal, and the like).

Although not shown, it is contemplated that printer 1 can be connected to, and usable with, a data entry device, such as a keyboard, for entering alpha-numeric information necessary for preparation and design of a desired output. Printer 1 can include firmware (e.g., software designed on a platform such as Windows CE™), available from Microsoft and software for controlling, in whole or in part, various printer assemblies, among them cutting assembly 30. Frame 8 can be designed to hold programmable memory devices known as flash cards that can be used to store firmware and software routines. Flash cards are typically used during product development to facilitate updates to the firmware and other software. Flash cards can be replaced by permanently programmed memory chips. Using the above-described firmware and software and the associated memory devices, printer assemblies such as cutter assembly 30 can be activated and controlled in an automated fashion.

Figure 3:
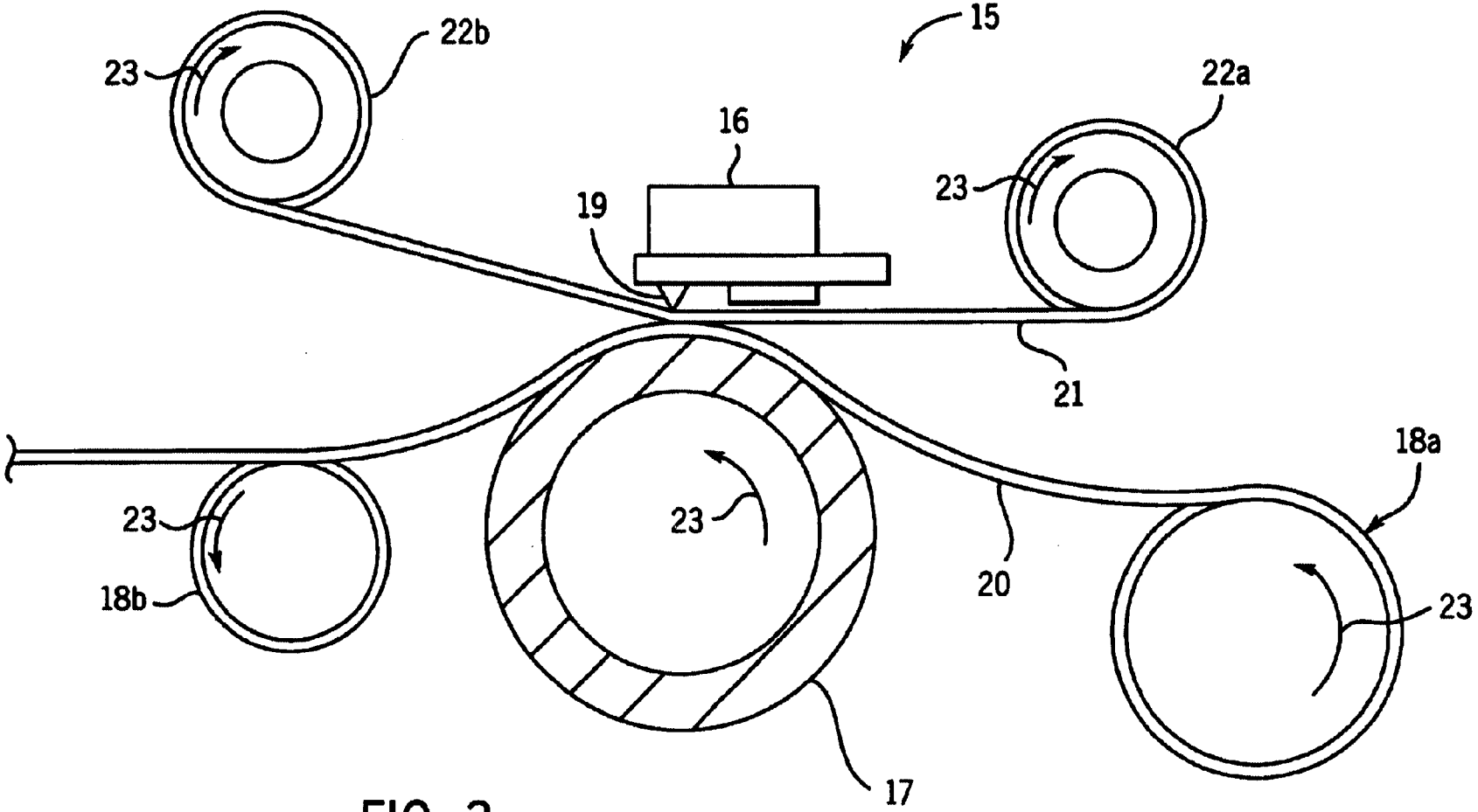
FIG. 3 is a schematic illustration of one embodiment of a printing arrangement that can be used with the label printer of FIG. 1.

A typical thermal printing arrangement 15 is illustrated schematically in FIG. 3 since, in a preferred embodiment, the label printer of FIG. 1 can be a thermal label printer.

Printing arrangement 15 includes print head 16, support (platen) roller 17, label media delivery roller 18*a*, and label media take-up roller 18*b*. Label media delivery and take-up rollers 18*a,b* can be separate components, or alternatively, they can be housed within a unitary structure (e.g., a label media supply cartridge). Print head 16 is typically equipped with a linear array of thermal elements 19. The number of thermal elements 19 in the linear array can vary, with a characteristic print head 16 employing one thousand two hundred forty-eight (1,248) thermal elements 19. Thermal elements 19 produce heat in response to energy supplied to print head 16. A current is applied to thermal elements 19 to heat the thermal elements to a level sufficient to transfer dots onto label media 20. This occurs when a thermally-sensitive supply 21 (e.g., an ink ribbon) comes into thermal contact with thermal elements 19. Printing arrangement 15 includes thermally-sensitive supply delivery roller 22*a*, and thermally-sensitive supply take-up roller 22*b*. Thermally-sensitive supply delivery and take-up rollers 22*a,b* can be separate components, or alternatively, they can be housed within a unitary structure (e.g., an ink ribbon cartridge). It is contemplated that color printing can be accomplished as well as black (along with shades of gray). Directional arrows 23 indicate the direction of travel of platen roller 17, label media delivery and take-up rollers 18*a,b* and thermally-sensitive supply delivery and take-up rollers 22*a,b* in printing arrangement 15.

Figure 4:
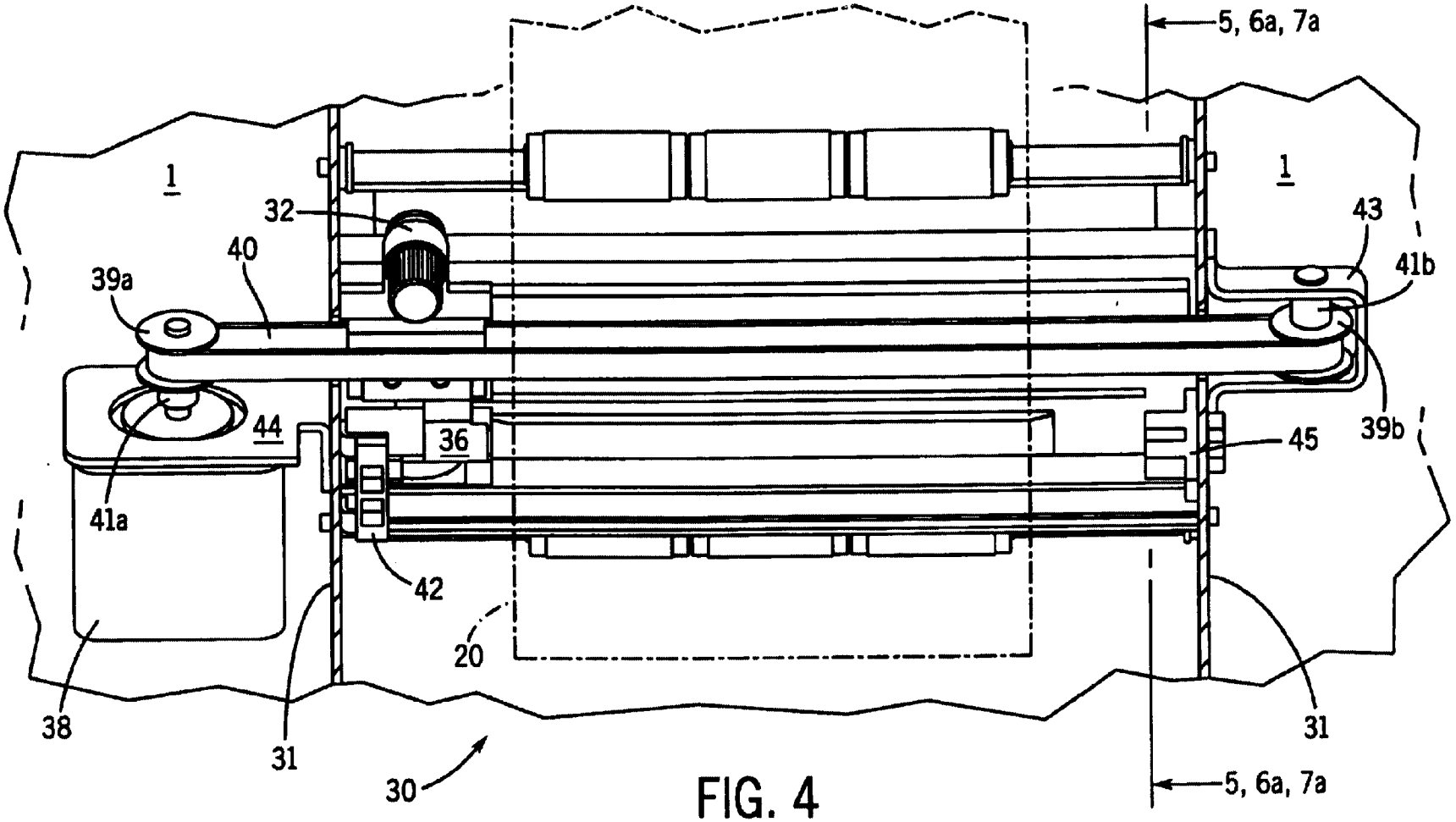
FIG. 4 is an elevational view taken along line 4—4 of FIG. 2 illustrating one embodiment of a label printer end and plotter cutting assembly according to one aspect of the present invention.

Referring to FIG. 4, an enlarged cross-sectional view taken along line 4–4 of FIG. 2 illustrating one embodiment of label printer cutting assembly 30 connected to frame 31 of printer 1 is shown according to one aspect of the present invention. Cutting assembly 30 includes a plotter cutter 32 to effect plotter cutting of label media 20 (shown in phantom) to form one or more discrete labels. The cutting assembly further includes end cutter 36 to effect end cutting (also called "shear cutting" or cutting off) of a label media. Thus, cutting assembly 30 includes, in a preferred embodiment, separate or distinct plotter and end cutters. It will be recognized that end cutting can take place with or without plotter cutting of the label having first taken place.

Cutting assembly 30 is generally driven using a drive mechanism, here shown as step motor 38. The manner in which cutting assembly 30 is driven is described in greater detail with reference to various figures below, but it is noted that belt 40 is a timing belt that is used generally to effect proper cutting of label media 20 via the cutting assembly. As shown, timing belt 40 is driven by step motor 38 via pulleys 39*a,b* that are connected to shafts 41*a,b*, respectively, with shaft 41*a* connected to step motor 38 and shaft 41*b* connected to bracket 43. Bracket 43 is connected to frame 31. Step motor 38 is also connected to frame 31 by bracket 44. As shown, in a preferred embodiment, end cutter home sensor 42 and plotter cutter home sensor 45 are included in the cutting assembly connected to frame 31. Sensor 42 is used to determine when end cutter 36 has reached, or is located at, a home or rest position. Similarly, sensor 45 is used to determine when plotter cutter 32 has reached, or is located at, a home or rest position. As a practical matter, the home or rest position for the end cutter (and similarly for the plotter cutter) can be reversed, or at any convenient location within frame 31, since the firmware and/or software associated with the label printer can accommodate such positional variation.

Figure 5:
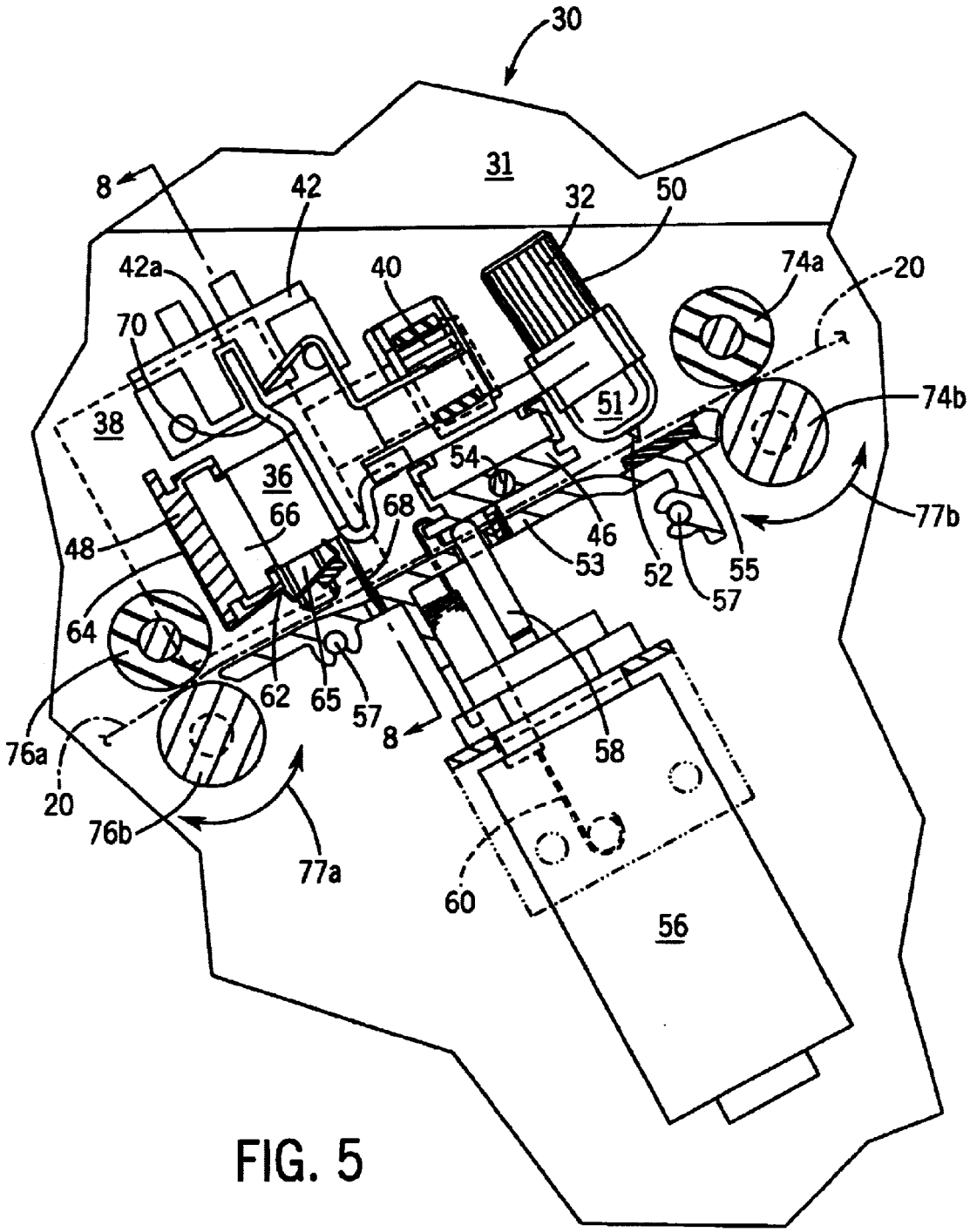
FIG. 5 shows an enlarged cross-sectional view taken along line 5—5 of FIG. 4.
Figure 6A:
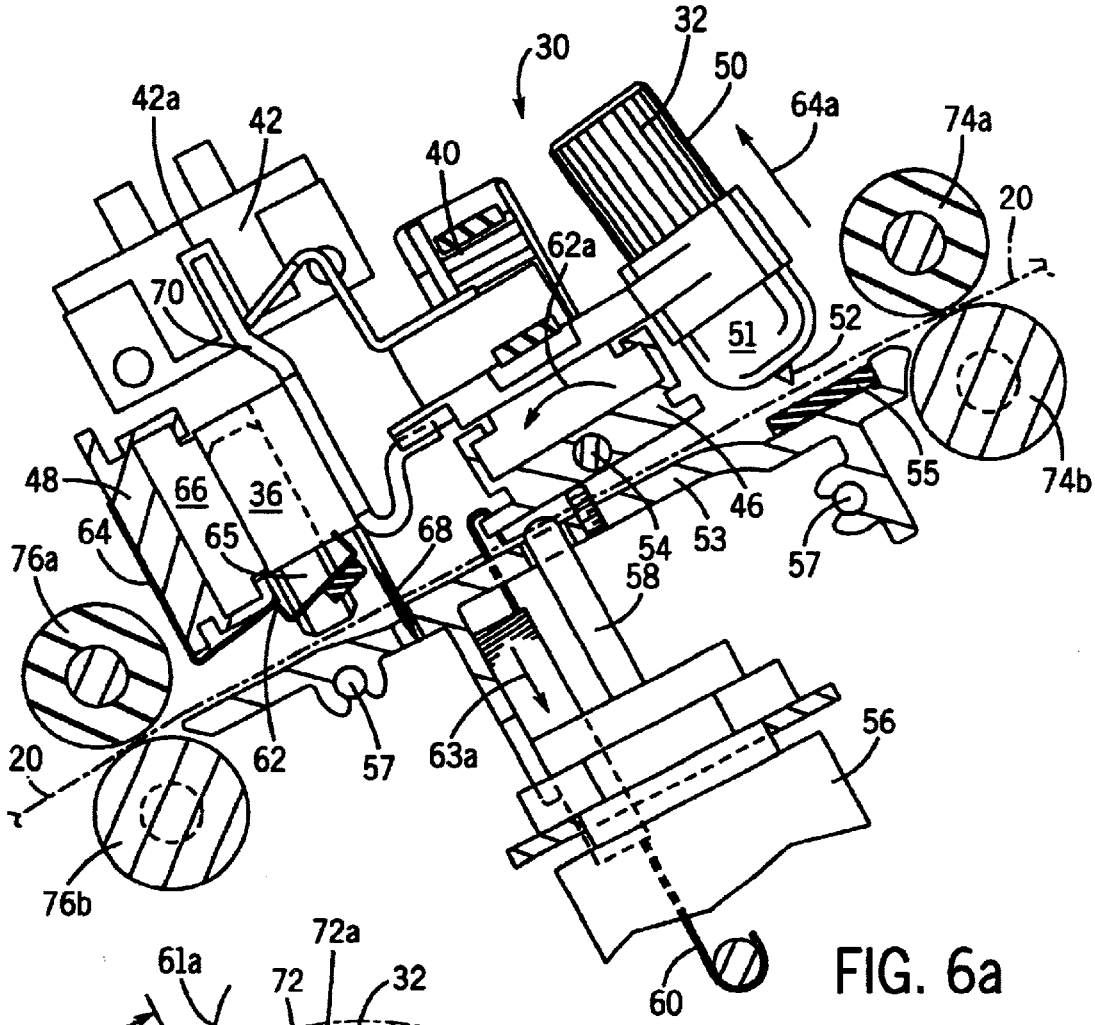
FIG. 6*a* shows an enlarged cross-sectional view taken along line 6*a*—6*a* of FIG. 4 illustrating one embodiment of the label printer end and plotter cutting assembly having a plotter that is coupled to an end cutter.
Figure 7A:
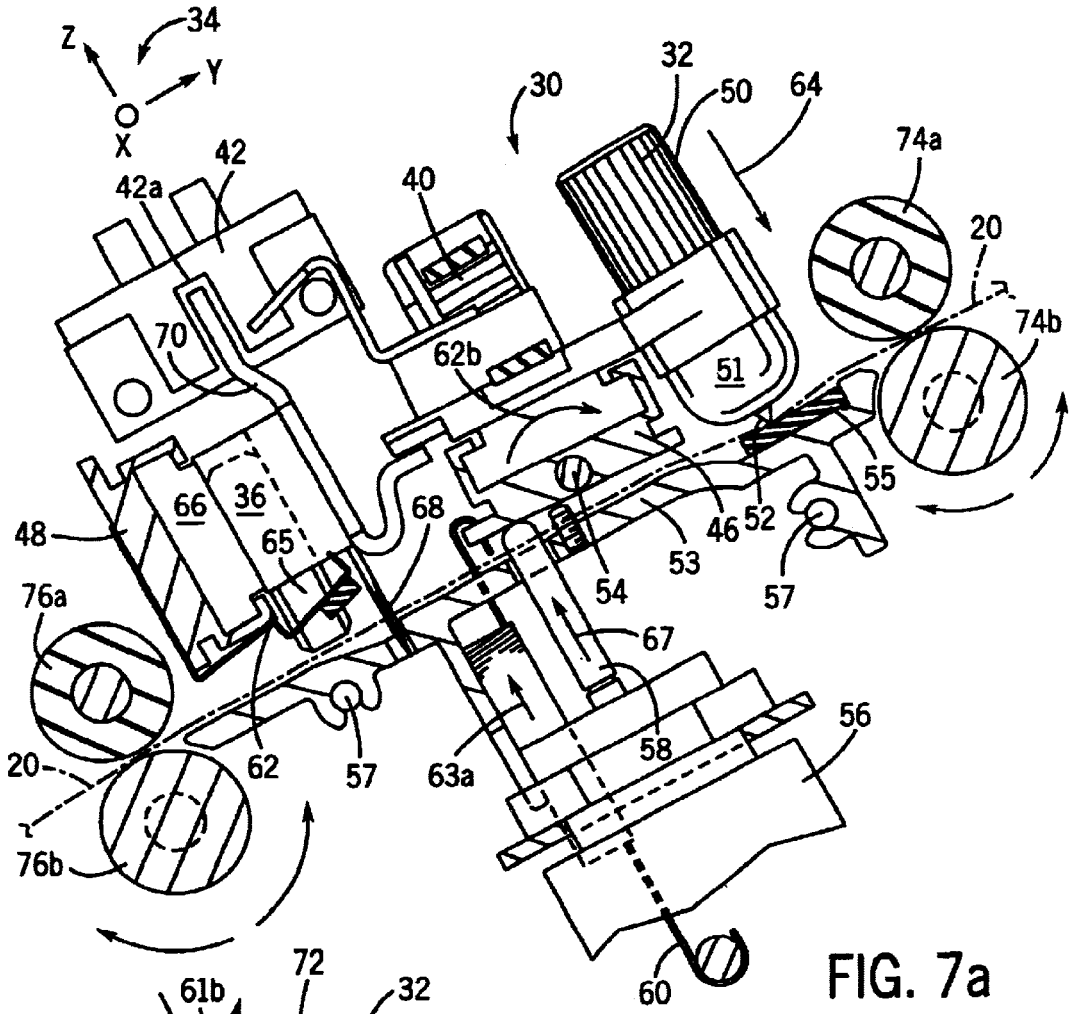
FIG. 7*a* shows an enlarged cross-sectional view taken along line 7*a*—7*a* of FIG. 4 illustrating one embodiment of the label printer and plotter cutting assembly where the plotter cutter is uncoupled from the end cutter.

FIGS. 5, 6*a* and 7*a*, show enlarged detailed cross-sectional views taken from FIG. 4. Cutting assembly 30 is shown and includes plotter cutter 32 and end cutter 36. Plotter cutter 32 comprises knob 50 and a plotter cutter pin blade 52. Knob 50 is used to adjust plotter cutter cutting depth, such as an initial cutting depth of plotter cutter cutting pin blade 52. The initial blade cutting depth (i.e., blade protrusion) may be measured and set to a specific value at the time of label printer manufacture. Knob 50 adjusts cutting depth via connecting section or nose 51, and the depth is adjusted with respect to label media 20. Label media 20 rides on label support 53, which is connected to frame 31 of the label printer, here via connections 57. Label cutting pad 55 can be included below pin blade 52 between label media 20 and label support 53. Cutting pad 55 protects pin blade 52 so as to increase pin blade cutting life. Cutting pad 55 is typically made from materials such as nylon or Delrin ™ (a polyoxymethylene-type acetal resin).

Referring to FIGS. 5 and 6*a*, plotter cutter 32 engages and slides along plotter cutter slide rail 46 and end cutter ,36 engages and slides along end cutter slide rail 48. End cutter 36 comprises clamp 64 and clamp wheel 65 to permit the end cutter to slidably engage end cutter slide rail 48 via extension 66. End cutter slide rail 48 is fixedly mounted to cutter assembly frame 31. End cutter 36 further comprises cutter blade 68 to accomplish cutting off or shear cutting of label media 20. Plotter cutter slide rail 46 is pivotally mounted to cutter assembly frame 31 via pivot 54 (e.g., a pin, screw or other rotation-permitting connector). A solenoid 56, or other force-generating mechanism (e.g., a motor and lever mechanism), is connected to plotter cutter slide rail 46 via a connection or armature 58. Rollers 74*a,b* and 76*a,b* rotate and serve to position label media 20 in cutting assembly 30 for cutting. Rollers 74*a* and 76*a* rotate in the same direction (i.e., clockwise or counterclockwise) and rollers 74*b* and 76*b* will both correspondingly rotate in an opposite direction to rollers 74*a* and 76*a*. End cutter home sensor 42 senses when end cutter extension or flag 70 activates (e.g., using an optical technology) the sensor via end cutter home sensor slot 42*a*. Belt 40 drives plotter cutter 32 and end cutter 36 to effect proper cutting of label media 20 in cutting assembly 30.

Figure 6B:
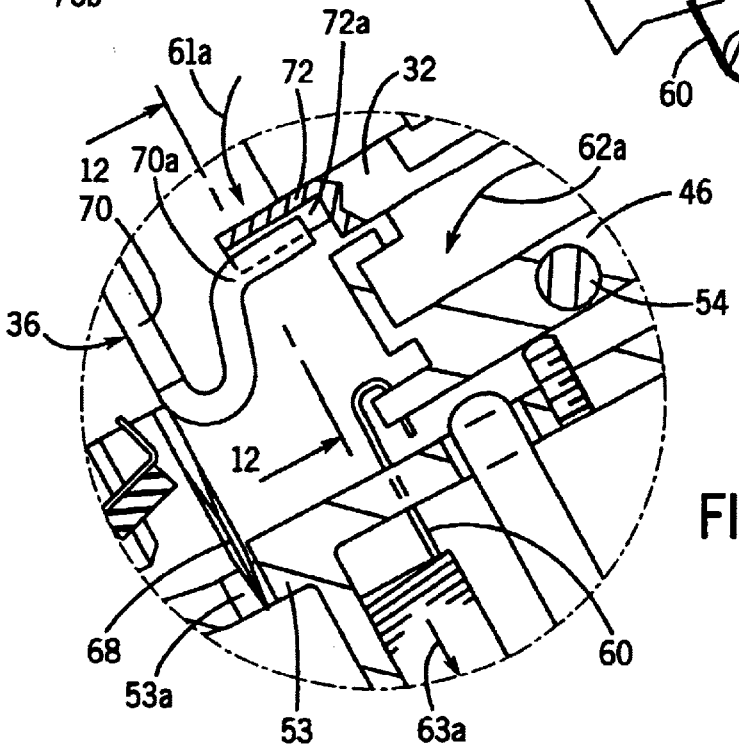
FIG. 6*b* is an enlarged detailed view taken along lines 6*b*—6*b* of FIG. 6*a*.

Referring generally to FIGS. 6*a–b*, plotter cutter 32 and end cutter 36 are shown coupled together. Plotter cutter 32 is shown in a rest position (i.e., a position in which plotter cutting does not take place). Spring 60 is attached to plotter cutter slide rail 46. Compressive force of spring 60, indicated by arrow 63*a*, rotates plotter cutter slide rail 46 about pivot 54 , with the rotation about the pivot indicated by arrow 62*a*. Accordingly, plotter cutter 32 and its blade 52 are lifted, as indicated by arrow 69*a* off of label media 20 when plotter cutting is not taking place.

FIG. 6*b* is an enlarged detailed view taken along line 6*b*—6*b* of FIG. 6*a*. Extension 70 of end cutter 36 engages extension 72 of plotter cutter 32. In one preferred embodiment, end cutter extension 70 comprises a tab portion 70*a* for engaging extension 72 detent portion 72*a*. Plotter cutter detent portion 72*a* engages end cutter extension 70*a* in a direction corresponding to 61*a*. It is understood, however, that other connection arrangements are possible and are known to those of skill for effecting coupling between the respective extensions. For example, the tab-detent arrangement can be reversed such that end cutter extension comprises a detent portion and plotter cutter extension comprises a tab portion. As illustrated, in a preferred embodiment, coupling of plotter cutter 32 and end cutter 36 occurs during an end cutter cutting sequence or operation (i.e., when end-cutting a label media). FIGS. 11–13 and 14*a–d* illustrate operation of the cutting assembly, including an exemplary end-cutter cutting sequence, and are described in greater detail below. FIG. 6*b* also illustrates that end cutter blade 68 rides within label support 53 channel 53*a* to effect end-cutting of a label media.

Figure 7B:
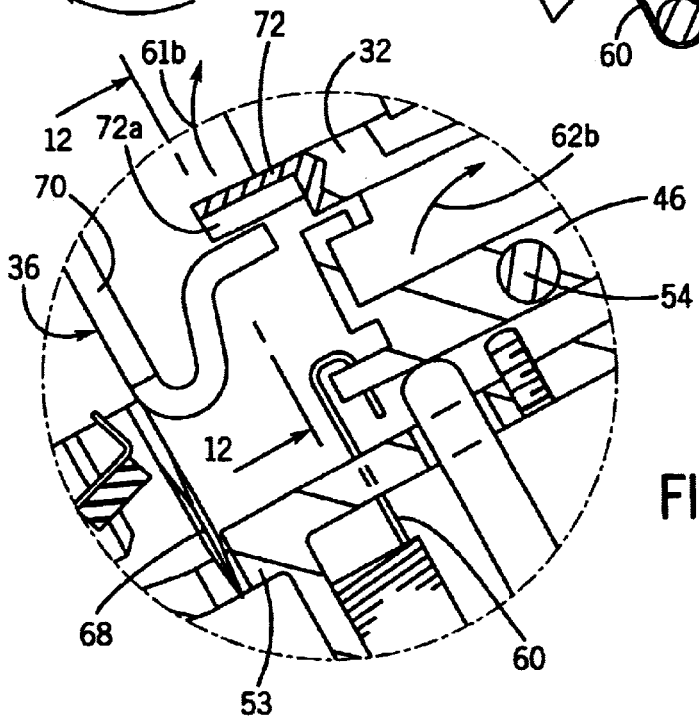
FIG. 7*b* is an enlarged detailed view taken along lines 7*b*—7*b* of FIG. 7*a*.

Referring generally to FIGS. 7*a–b*, plotter cutter 32 and end cutter 36 are shown uncoupled. Here, the plotter cutter in a plotter cutting position, that is, a position to effect plotter cutting of label media 20 into discrete labels (not shown). Plotter cutter 32 is shown engaged to solenoid 56, or other force generating mechanism. Generally, solenoid 56 forces armature 58 upwardly, indicated by arrow 67 (FIG. 7*a*). The solenoid force overcomes the tensile force of spring 60 (thereby extending the spring) in tension so as to rotate or tilt plotter cutter slide rail 46 about pivot 54, indicated by arrow 62*b*. Plotter cutter 32 is thus placed in a plotter cutting position to cut label media 20 with the position located over cutting pad 55. The downward motion of plotter cutter 32 into the plotter cutting position is indicated by arrow 69*b* (FIG. 7*a*).

FIG. 7*b* is an enlarged detailed view taken along line 7*b*—7*b* of FIG. 7*a*. To effect plotter cutting, extension 70 of end cutter 36 disengages from extension 72 of plotter cutter 32. In a reverse motion from that shown in FIG. 6*b*, plotter cutter detent portion 72*a* disengages from end cutter extension tab portion 70*a* in a direction corresponding to 61*b*. Again, it is understood that other connection arrangements are possible and are known to those of skill in the art.

Operation of the plotter cutter is more fully described in a co-pending U.S. patent application entitled "Label Media-Specific Plotter Cutter Depth Control" filed concurrently with the present application and which is fully incorporated herein by reference.

Figure 8:
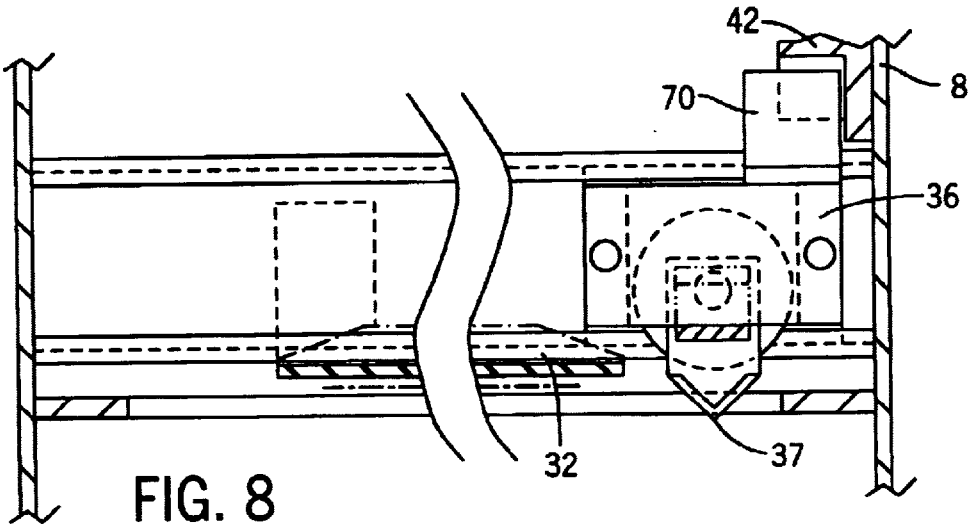
FIG. 8 is a cross-sectional view of the label printer end and plotter cutting assembly taken along line 8—8 of FIG. 5 showing the end cutter in a home or rest position.

FIG. 8 is a cross-sectional view of the cutting assembly taken along line 8—8 of FIG. 5. End cutter 36 is parked or stopped in a home or rest position, designated as a location proximate to sensor 42, within frame 8. Sensor 42 senses the end cutter using flag 70. In a preferred embodiment, end cutter 36 includes a pointed blade portion 37 to effect end or shear cutting. In other embodiments, rolling-type or scissors-type end cutters (not shown) can be used to effect end cutting of the label media.

Figure 9:
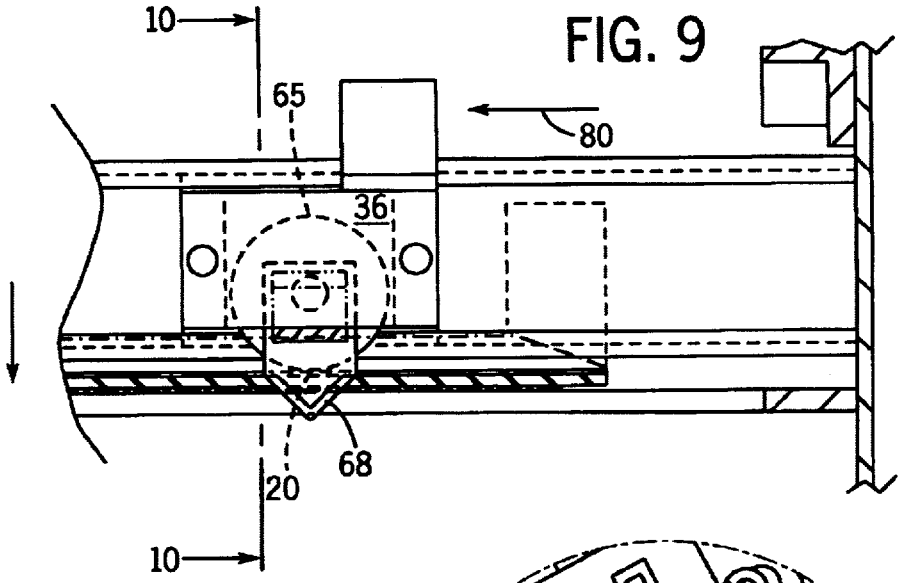
FIG. 9 is a cross-sectional view of a portion of FIG. 8 illustrating the label printer end and plotter cutting assembly in accordance with one aspect of the present invention.
Figure 10:
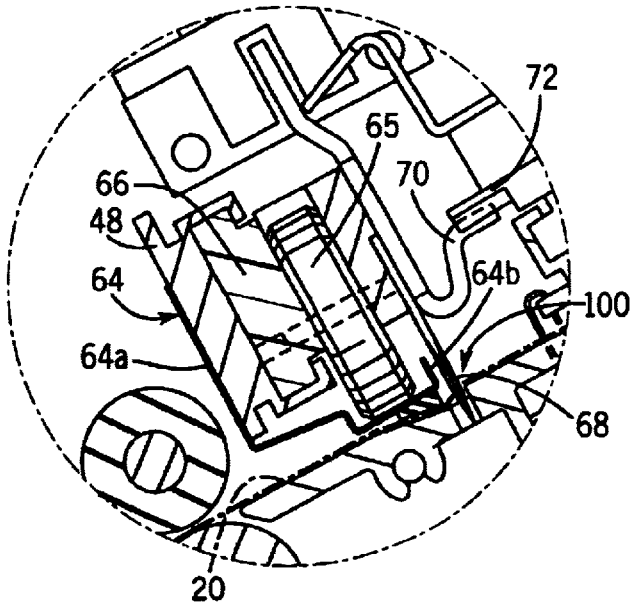
FIG. 10 is an enlarged cross-sectional view taken along line 10—10 of FIG. 9.

Referring to FIGS. 9–10, end cutter 36 rolls in a direction indicated by arrow 80. End cutter clamp wheel 65 rollingly engages clamp 64. Wheel 65 drives the clamp in a downward direction. Clamp 64, comprises a spring-loaded sheet metal portion 64*a* and cushion (e.g., elastomer, foam or rubber) portion 64*b* for distributing clamping pressure. End cutter 36 slides along end cutter along rail 48 via extension 66. End cutter 36 end or shear cuts via blade 68 label media 20 at a cutting location generally designated as 100. Wheel 65 maintains an appropriate cutting pressure on label media 20 at cutting location 100 using clamp portion 64*b*. When end cutting occurs, plotter cutter 32 (FIGS. 6*a*–7*a*) and end cutter 36 (FIG. 9) are coupled together via plotter and end cutter extensions 70, 72 respectively. Thus, while the plotter cutter and the end cutter are distinct and/or separate cutting mechanisms that can accomplish distinct and/or separate cutting operations, when coupled, the two are driven together.

Figure 11:
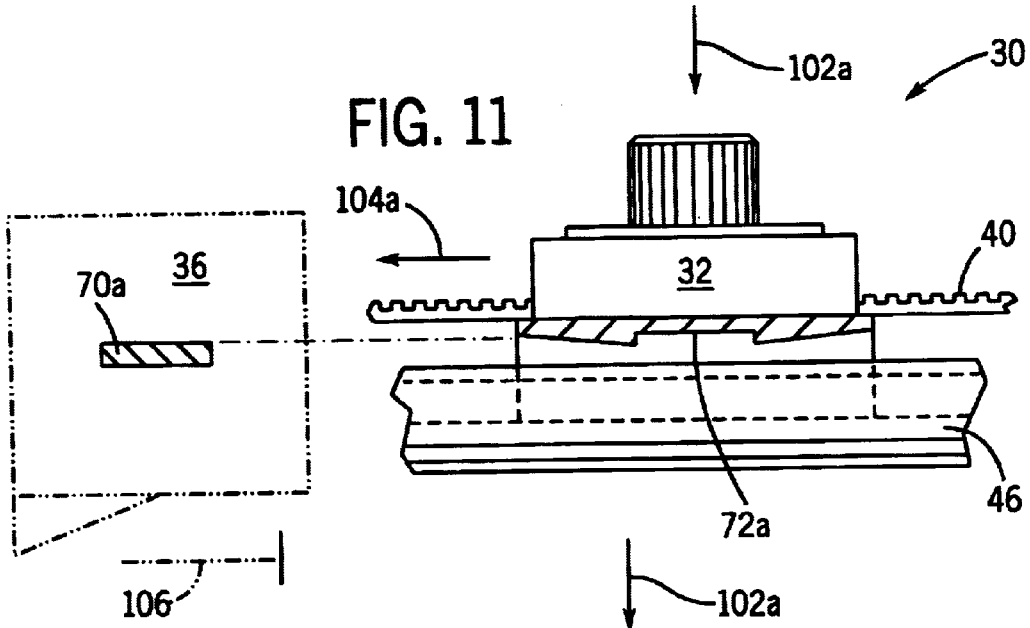
FIG. 11 is a partial sectional view of the end and plotter cutting assembly with the plotter cutter shown uncoupled from the end cutter in an exemplary cutting sequence or operation.
Figure 12:
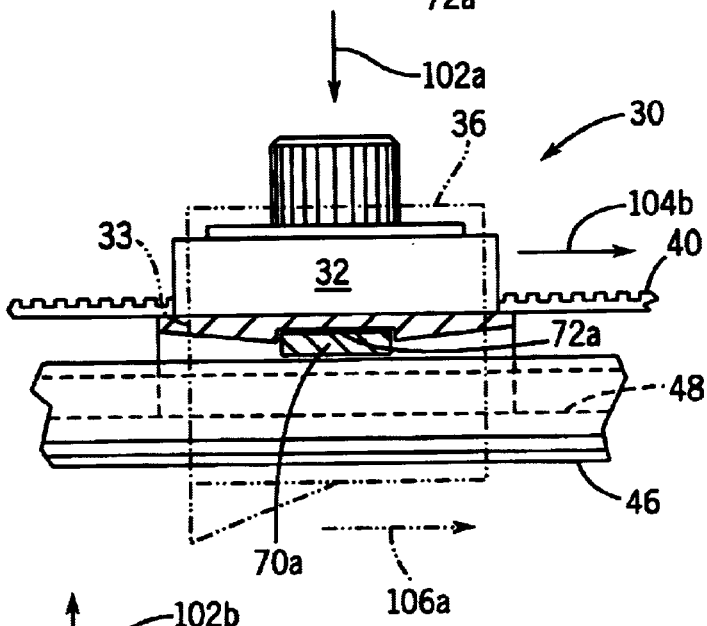
FIG. 12 is a partial sectional view taken along line 12—12 of FIG. 6*b* showing the end and plotter cutting assembly with the plotter cutter coupled to the end cutter in an exemplary cutting sequence.
Figure 13:
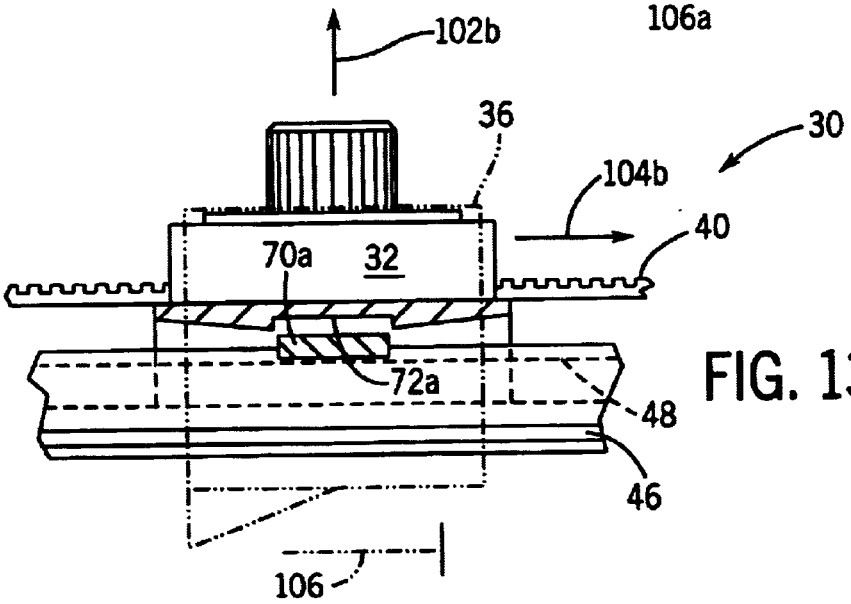
FIG. 13 is a partial sectional view similar to that of FIG. 12 showing the end and plotter cutting assembly, with the plotter cutter uncoupled from the end cutter in an exemplary cutting sequence or operation.

FIGS. 11–13 are partially schematic cross-sectional views illustrating one embodiment of cutting assembly 30 carrying out an exemplary cutting sequence. In FIG. 11, plotter cutter 32 is positioned for, but shown prior to, coupling to end cutter 36, with the position of the plotter cutter indicated by arrow 102*a*. Specifically, plotter cutter detent portion 72*a* is shown uncoupled from end cutter tab portion 70*a*. Plotter cutter 36 is driven along plotter cutter slide rail 46 by belt 40 and motor (not shown), towards end cutter 36, as indicated by arrow 104*a*. End cutter 36 (shown in cross-hatched lines) is stationary, as indicated by hashed marks 106.

In FIG. 12, plotter cutter 32 is positioned for, but shown during, coupling to end cutter 36, with the position of the plotter cutter indicated by arrow 102*a*. Specifically, plotter cutter detent portion 72*a* is shown coupled to end cutter tab portion 70*a*. End cutter 36 (shown in cross-hatched lines) and plotter cutter 32 are now capable of both being driven along, as indicated by arrows 104*b* and 106*a*, using belt 40 because of the connection because of the coupling between tab portion 70*a* and detent portion 72*a*. End cutter 36 is stationary, as indicated by hashed marks 106.

In FIG. 13, plotter cutter 32 is positioned for, but shown just after, uncoupling from end cutter 36, with the positioning of the plotter cutter indicated by arrow 102*b*. Specifically, plotter cutter detent portion 72*a* is shown uncoupled from end cutter tab portion 70*a*. Plotter cutter 36 is driven along plotter cutter slide rail 46 using belt 40, away from end cutter 36, as indicated by arrow 104*b*. End cutter 36 (shown in cross-hatched lines) is again stationary, as indicated by hashed marks 106.

Figure 14A:
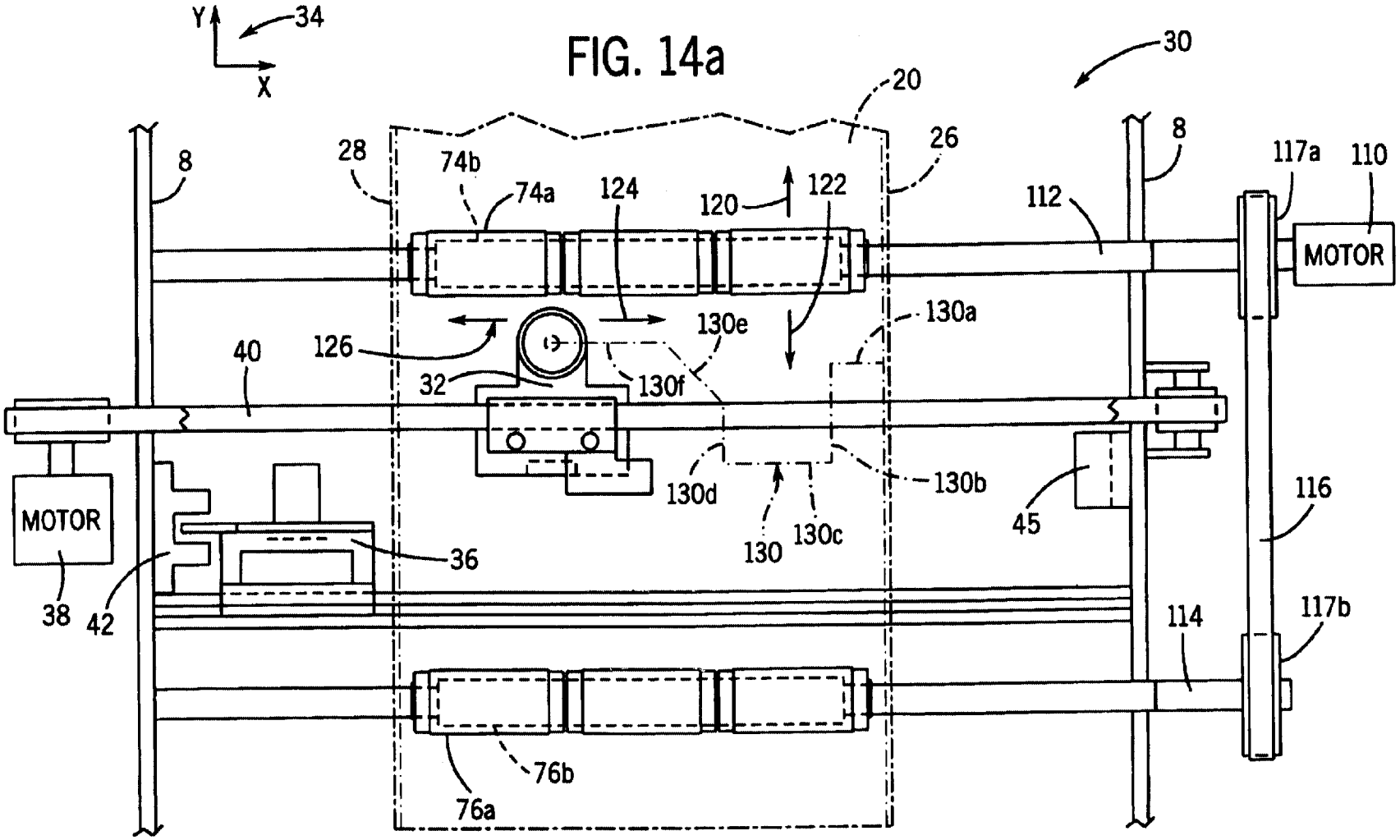
FIGS. 14*a*–*d* show top, partially schematic views of the end and plotter cutting assembly accomplishing a cutting sequence or operation in accordance with one aspect of the present invention.

FIG. 14*a* shows a top, partially schematic view of the cutting assembly plotter cutter accomplishing an exemplary plotter cutting sequence along a cutting path 130 in accordance with one aspect of the present invention. Cutting path 130 is representative of a plotter cut that has already taken place. Cartesian coordinates 34 are included here and in FIGS. 14*a–d* generally for clarification purposes. Plotter cutter 32 is driven, as noted previously, by a drive mechanism, such as step motor 38, using belt 40. Plotter cutter 32, as shown, can move in both positive and negative x directions, as indicated by arrows 124 and 126, respectively. Label media 20 is driven by a drive mechanism, such as step motor 110. Motor 110 drives label media in a positive or negative y direction, indicated by arrows 120 and 122, respectively, via driving rollers 74*b* and 76*b* (shown in phantom). Rollers 74*b* and 76*b* are connected to motor 110 via shafts 112 and 114. Belt 116 and pulleys 117*a,b* permit driving of both roller sets by a single drive mechanism. Rollers 74*a* and 76*a*, as shown, are pinch or passive rollers.

FIG. 14*a* illustrates an exemplary plotter cutting sequence. Plotter cutter 32 is shown having traversed label media 20 from a right edge 26 to a left edge 28 of the media (in a negative x direction) to create cutting path 130. During the cutting operation that has taken place to institute a plotter cut along path 130, label media 20 has been moved in both positive and negative y directions. More specifically, cutting path 130 includes cutting path portions 130*a–f*, where each of the portions corresponds to plotter cutter 32 and/or label media 20 movement as follows: portion 130*a* corresponds to negative x cutting by the plotter cutter while the label media remains stationary; portion 130*b* corresponds to positive y movement of the label media while the plotter cutter cuts but remains stationary; portion 130*c* corresponds to negative x cutting by the plotter cutter while the label media remains stationary; portion 130*d* corresponds to negative y movement of the label media while the plotter cutter cuts but remains stationary; portion 130*e* corresponds to negative x cutting by the plotter cutter as well as negative y movement of the label media; and portion 130*f* corresponds to negative x cutting of the plotter cutter while the label media remains stationary. In this manner, discrete labels of virtually any shape can be created.

Figure 14B:
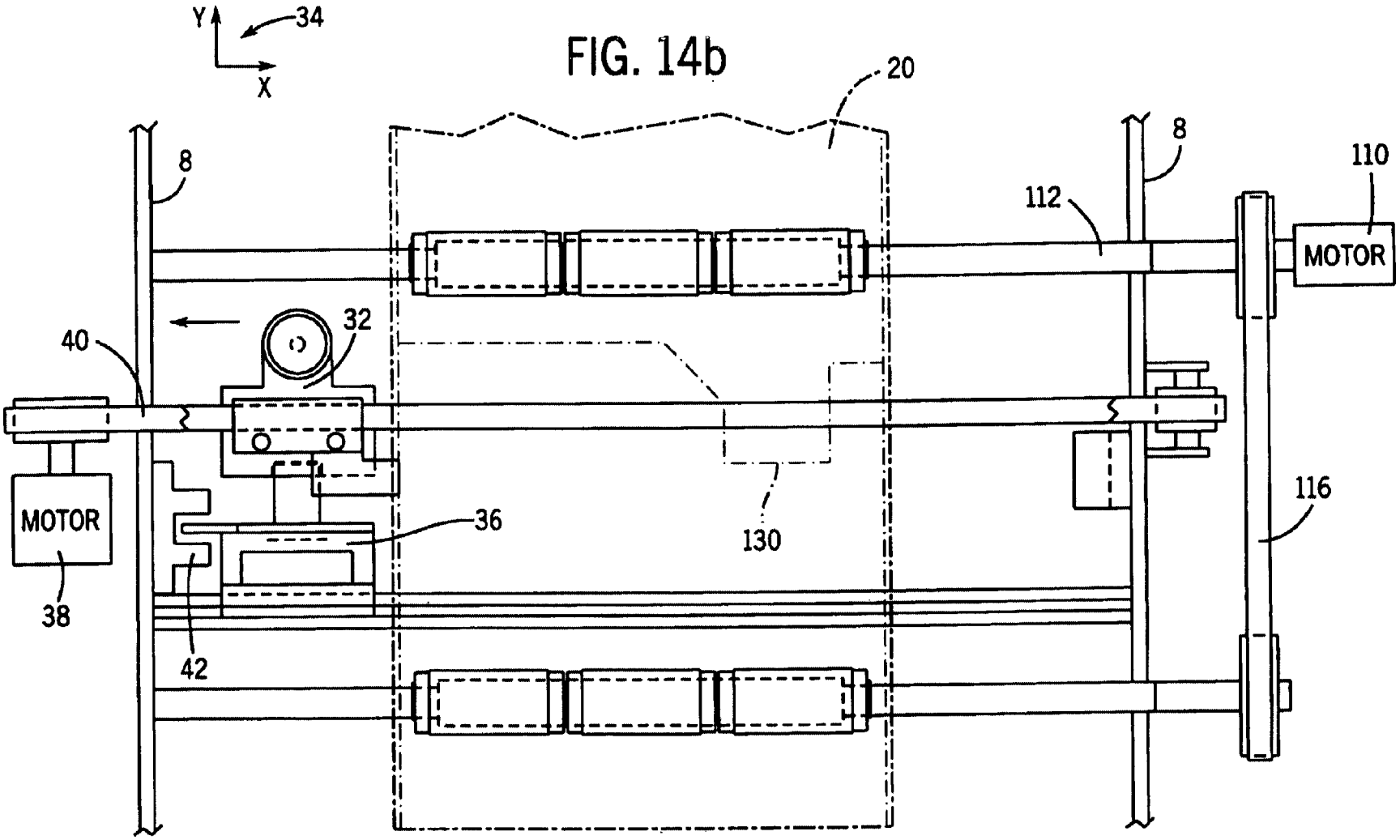

In FIG. 14*b*, plotter cutter 32 is moving in a negative x direction. Plotter cutter 32 has traversed the entirety of label media 20 along cutting path 130. Plotter cutter 32 can then couple to end cutter 36 which, as shown, is positioned proximate to sensor 42 (i.e., in its home or rest position).

Figure 14C:
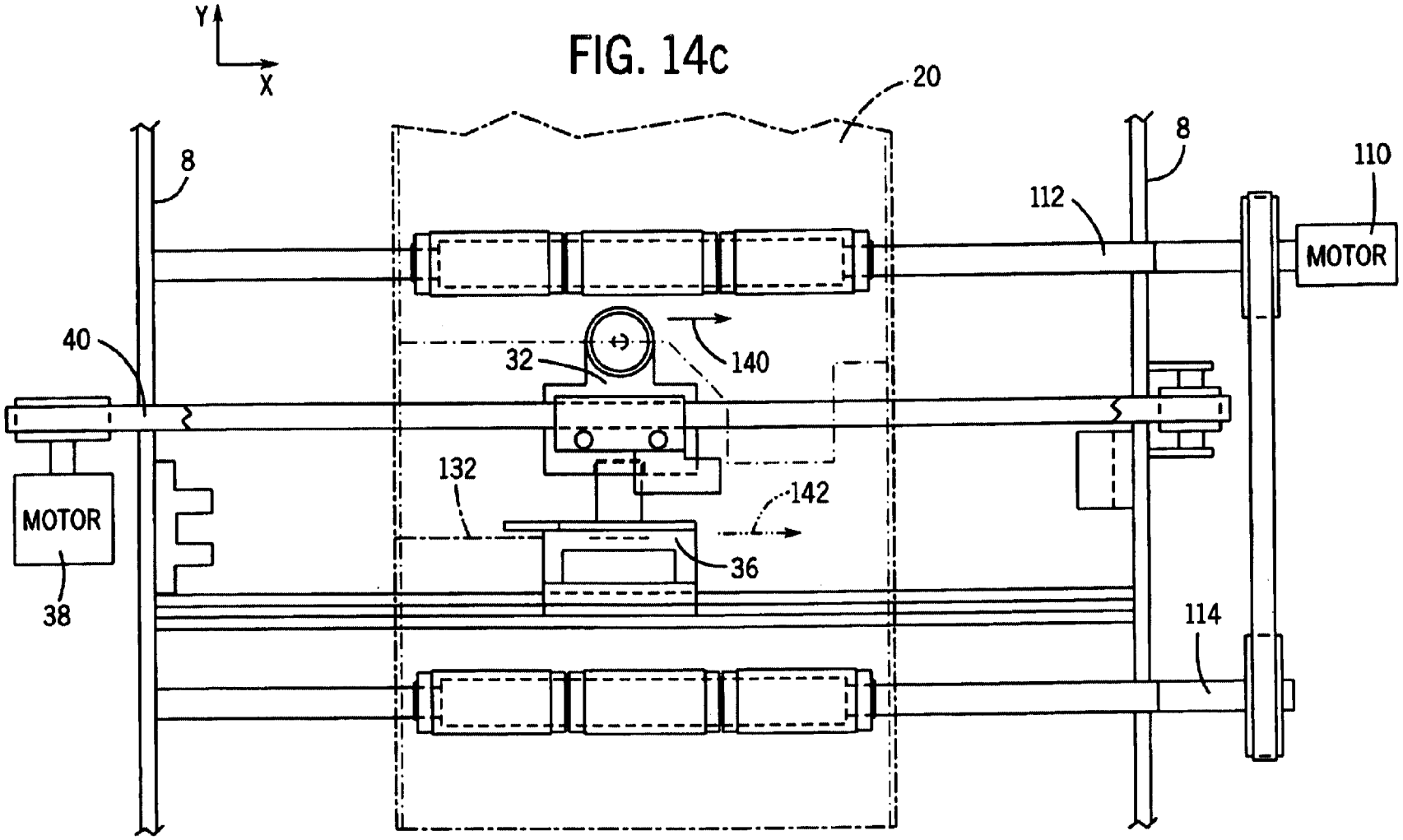

FIG. 14*c* shows an end cutting sequence that follows the plotter cutting sequence illustrated in FIGS. 14*a–b*. It should be understood that the end cutting illustrated here need not follow such a plotter cutting sequence (i.e., end cutting can take place with or without plotter cutting). Plotter cutter 32 is coupled to, and travels along with, end cutter 36, as indicated by arrows 140 and 142 (shown in dashed lines) to effect end cutting along end cutting path 132. Accordingly, it can be seen that plotter cutter 32 and end cutter 36 are driven by a common drive mechanism, in this case motor 38, via belt 40.

Figure 14D:
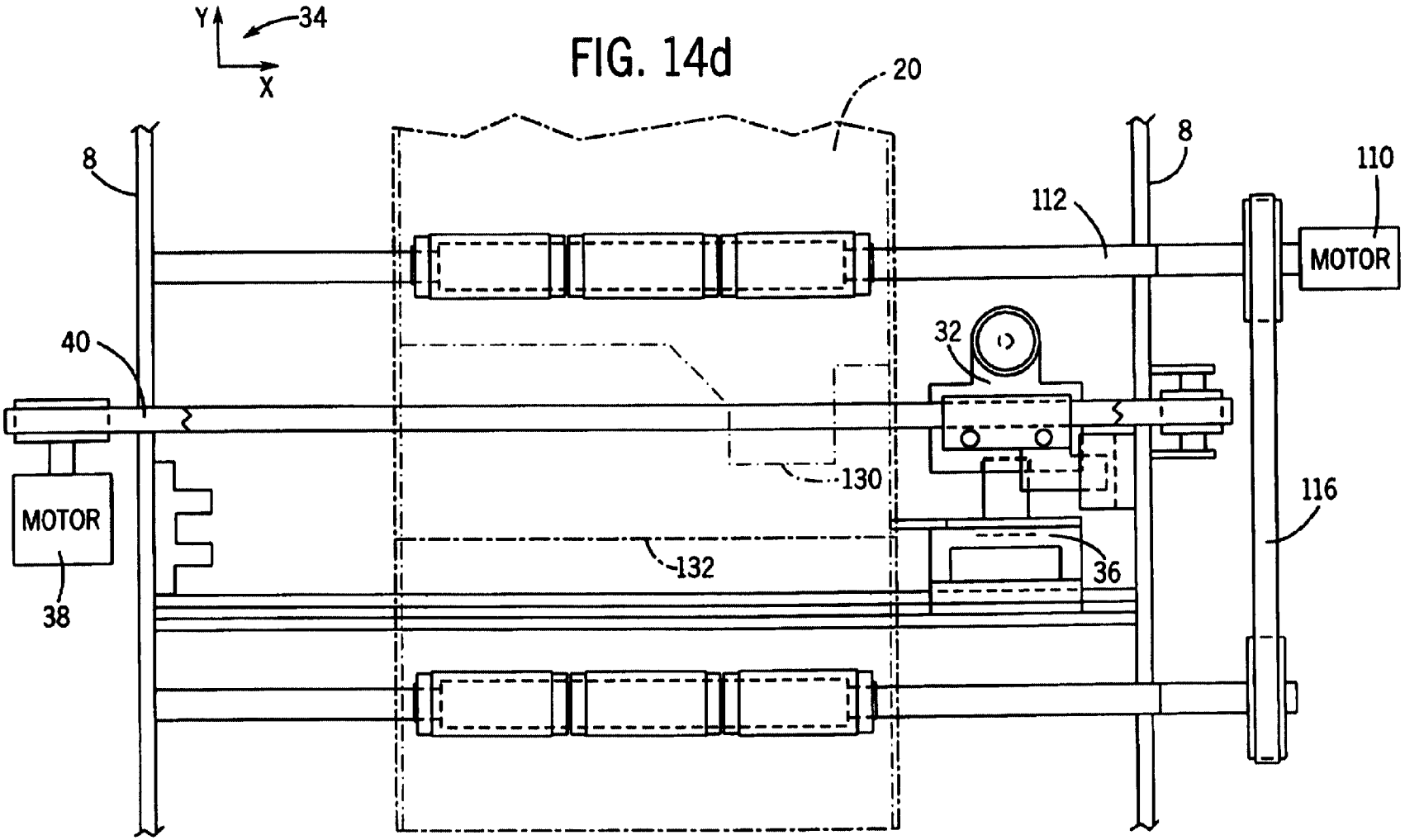

And in FIG. 14*d*, plotter cutter 32 and end cutter 36 have traversed label media 20 having accomplished plotter cutting and end cutting operations along plotter and end cutting paths 130, 132, respectively. Using motor 38, plotter cutter 32 and end cutter 36 can be driven to institute further cutting (i.e., additional end cutting and/or plotter cutting sequences) as desired.

It is understood and contemplated that the exact number and location of the rollers can vary to convenience, so long as effective cutting of the label media—be it plotter cutting or end cutting—can take place to create a properly sized and shaped label. Moreover, it is contemplated that in other preferred embodiments (not shown), individual rollers may be either driving or passive rollers and that the selection of the roller type for a specific roller can be varied to convenience so long as proper movement of the label media is accomplished, and may even include embodiments in which the driving roller located distal from the cutting assembly. For example, in one embodiment (not shown), the label media can be driven by a platen roller that is located proximate to a print head.

While a particular preferred embodiment has been shown and described above, it is apparent that the teachings of this invention may be applied utilizing other hardware performing the same or equivalent functions. It is contemplated that cartridges for holding and/or supplying one or both of the ribbon and/or label media supplies can be of the "re-usable" (also called "refillable") type, but preferably are of the "disposable" type.

Methods have been described and outlined in a sequential fashion. Still, elimination, modification, rearrangement, combination, reordering, or the like, of the methods is contemplated and considered within the scope of the appending claims.

In general, while the present invention has been described in terms of preferred embodiments, it is recognized that equivalents, alternatives, and modifications, aside from those expressly stated, are possible and within the scope of the appending claims.

What is claimed is:

1. A label media end and plotter cutting assembly comprising:

a cutting assembly frame;

a plotter cutter slide rail pivotally secured to the cutting assembly frame;

a plotter cutter connected to the plotter cutter slide rail for plotter cutting a label media;

an end cutter slide rail secured to the cutting assembly frame;

an end cutter connected to the end cutter slide rail for end cutting the label media; and a drive mechanism connected to the plotter cutter and the end cutter for driving at least one of the plotter cutter to perform a plotter cut to the label media and an end cutter to perform an end cut to the label media.

2. The cutting assembly of claim 1 wherein the drive mechanism is a step motor.

3. The cutting assembly of claim 1 wherein at least one of the end and plotter cutters are connected to the drive mechanism via a timing belt.

4. The cutting assembly of claim 1 further comprising a force-generating mechanism for positioning the plotter cutter in a plotter cutting position to plotter cut the label media.

5. The cutting assembly of claim 4 wherein the force-generating mechanism is a solenoid connected to the plotter cutter and wherein the solenoid generates a force to position the plotter cutter in the plotter cutting position.

6. The cutting assembly of claim 1 wherein the end cutter slide rail is fixedly secured to the cutting assembly frame.

7. The cutting assembly of claim 1 wherein the plotter cutter can be coupled to the end cutter such that the drive mechanism is capable of driving both the plotter cutter and the end cutter.

8. The cutting assembly of claim 1 wherein the plotter cutter can be uncoupled from the end cutter such that drive mechanism is capable of driving only the plotter cutter.

9. A cutting assembly for use with a label printer, the cutting assembly comprising:

a cutting assembly frame; a plotter cutter for plotter cutting a label media, the plotter cutter connected to the cutting assembly frame;

an end cutter for end cutting the label media, the end cutter connected to the cutting assembly frame; and a drive mechanism connected to the plotter cutter and the end cutter for selectively driving at least one of the plotter cutter to effect plotter cutting of the label media and the end cutter to effect end cutting of the label media.

10. The cutting assembly of claim 9 wherein the drive mechanism is a step motor.

11. The cutting assembly of claim 9 wherein the cutting assembly frame is connected to a label printer frame.

12. The cutting assembly of claim 9 further comprising a force-generating mechanism for positioning, by generating a force, the plotter cutter in a plotter cutting position.

13. The cutting assembly of claim 12 wherein the force-generating mechanism is a solenoid.

14. The cutting assembly of claim 9 wherein the plotter cutter can be coupled to the end cutter such that both the plotter cutter and end cutter are driven by the drive mechanism.

15. The cutting assembly of claim 9 wherein the plotter cutter can be uncoupled from the end cutter such that only the plotter cutter is driven by the drive mechanism.

16. A label printer comprising:

a label printer frame; and a label printer end and plotter cutting assembly, the cutting assembly comprising:

a cutting assembly frame connected to the label printer frame;

a plotter cutter slide rail pivotally secured to the cutting assembly frame;

a plotter cutter connected to the plotter cutter slide rail for plotter cutting a label media;

an end cutter slide rail secured to the cutting assembly frame;

an end cutter connected to the end cutter slide rail for end cutting the label media; and a drive mechanism connected to the plotter cutter and the end cutter for selectively driving at least one of the plotter cutter to perform a plotter cut to the label media and an end cutter to perform an end cut to the label media.

17. The cutting assembly of claim 16 wherein the plotter cutter can be coupled to the end cutter such that both the plotter cutter and end cutter are driven by the drive mechanism.

18. The cutting assembly of claim 16 wherein the plotter cutter can be uncoupled from the end cutter such that only the plotter cutter is driven by the drive mechanism.

19. The cutting assembly of claim 16 further comprising a force-generating mechanism for positioning, by generating a force, the plotter cutter in a plotter cutting position.

20. A method of making at least one of an end cut and a plotter cut to a label media, the method comprising:

providing a label media;

providing an end and plotter cutting assembly, the assembly comprising: a cutting assembly frame; a plotter cutter slide rail pivotally secured to the cutting assembly frame; a plotter cutter connected to the plotter cutter slide rail for plotter cutting a label media; an end cutter slide rail secured to the cutting assembly frame; an end cutter connected to the end cutter slide rail for end cutting a label media; and a drive mechanism connected to the plotter cutter and the end cutter; and selectively driving at least one of the plotter cutter to make a plotter cut to the label media and the end cutter to make an end cut to the label media.

21. The method of claim 20 wherein the label media comprises a release liner and a tape layer attached to the release liner.

22. The method of claim 20 wherein the drive mechanism is a step motor.

23. The method of claim 20 further comprising, prior to the driving, coupling the plotter cutter to the end cutter such that both the plotter cutter and end cutter are driven by the drive mechanism.

24. The method of claim 20 further comprising, prior to the driving, uncoupling the plotter cutter from the end cutter such that only the plotter cutter is driven by the drive mechanism.

25. The method of claim 24 further comprising, prior to the driving, rotating the plotter cutter slide rail about a pivot such that the plotter cutter is lifted off of the label media.

26. The method of claim 23 further comprising, prior to the driving, rotating the plotter cutter slide rail about a pivot such that the plotter cutter is lowered into a plotter cutting position to plotter cut the label media.

27. A label printer comprising:

a label printer frame; and a label printer end and plotter cutting assembly, the cutting assembly comprising:

a cutting assembly frame connected to the label printer frame;

a plotter cutter slide rail pivotally secured to the cutting assembly frame;

a plotter cutter connected to the plotter cutter slide rail for plotter cutting a label media;

an end cutter slide rail secured to the cutting assembly frame;

an end cutter connected to the end cutter slide rail for end cutting the label media; and a drive mechanism commonly connected to the plotter cutter and the end cutter;

wherein the plotter cutter can be coupled to the end cutter such that the drive mechanism can drive both the plotter cutter and end cutter and wherein the plotter cutter can be uncoupled from the end cutter such that the drive mechanism can drive only the plotter; and wherein the plotter cutter slide rail can be rotated about a pivot to lift the plotter cutter off of the label media to end cut the label media and to lower the plotter cutter into a plotter cutting position to plotter cut the label media.

28. The label printer of claim 27 wherein the plotter cutter and end cutter are coupleable using a tab portion and a detent portion.

29. The label printer of claim 28 wherein the end cutter comprises the tab portion and the plotter cutter comprises the detent portion for effecting coupling of the plotter cutter and the end cutter.

* * * * *